United States Patent [19]

Soffge et al.

[11] 4,023,226

[45] May 17, 1977

[54] TRANSPORT VEHICLE

[75] Inventors: Friedhelm Soffge; Archim Schubecker, both of Kornwestheim, Germany

[73] Assignee: Dr. -Ing. h.c.F. Porsche Aktiengesellschaft, Germany

[22] Filed: Jan. 27, 1975

[21] Appl. No.: 544,271

[30] Foreign Application Priority Data

Jan. 25, 1974 Germany ..... 2403494

[52] U.S. Cl. ..... 14/2.4

[51] Int. Cl.[2] ..... E01D 15/12

[58] Field of Search ..... 14/27, 1

[56] References Cited

UNITED STATES PATENTS

| | | | |
|---|---|---|---|
| 3,562,829 | 2/1971 | Soffge | 14/1 |
| 3,597,784 | 8/1971 | Gehlen | 14/1 |
| 3,820,181 | 6/1974 | Wagner | 14/1 |
| 3,845,514 | 11/1974 | Wagner | 14/1 |
| 3,871,045 | 3/1975 | Bouvet | 14/27 X |

*Primary Examiner*—Nile C. Byers

*Attorney, Agent, or Firm*—Craig & Antonelli

[57] ABSTRACT

A bridge transporting and installing vehicle for a multi-part bridge structure which is provided with a front and rear bridge section placer arrangement. The rear placer arrangement is swingably mounted on the vehicle and includes a connecting device for permitting the accommodation of bridge sections of varying length.

21 Claims, 6 Drawing Figures

TRANSPORT VEHICLE

The present invention relates to a vehicle for transporting and installing bridges, esepcially a vehicle for transporting and installing bridges which consist of at least two parts and which are transported in a folded position and unfolded and secured in an extended position during installation.

With known bridge transport and installing vehicles, for example, German DT-OS No. 1,658,622, the bridge portions to be transported and installed are of the same length and a first or lower bridge portion is supported and guided for movement on a front bridge section placer whereas a second or upper bridge portion is supported and guided at its front end on the lower bridge portion as well as at its rear end by a rear bridge section placer connected thereto and hinged to the vehicle. A disadvantage of this type of construction lies in the fact that only bridges of a certain length having sections of equal length may readily be combined and positioned above the rear placer.

The present invention is concerned with the task to provide a structurally simple bridge transporting and installing vehicle for transporting and placing bridge sections of differing lengths thereby eliminating the aforementioned shortcomings.

The underlying problems are solved in accordance with the present invention in that a bridge transport and placement vehicle for a multi-part sliding bridge structure is provided which permits the accommodation and positioning of bridge sections of differing lengths which may be connected without a complete constructional alteration of the basic bridge section placer and connecting arrangements.

According to the present invention a bridge transport and installation vehicle is provided which includes a first or front bridge section placer upon which is positioned a first bridge section which front placer is movable in the driving direction of the vehicle. A second or rear bridge section placer is also provided and is adapted to move the second bridge portion in a direction opposite to the movement of the first bridge section. The rear placer is pivotally mounted on the vehicle and is capable of lowering the second bridge section into the plane of the first bridge section. The rear placer is connected with the second bridge section which extends above the placer by way of guide means.

According to one feature of the present invention, a connecting arm or rod is provided at the rear placer for the selective reception of bridge portions of differing lengths by the rear placer. By this construction, an extension of the rear placer is realized in an extremely simple manner whereby shorter bridge sections may readily be transported and interconnected during the positioning process or installation of the bridge. Thus, by the present invention, the normal limitations as to the specific length of the bridge portions which can be transported and installed are avoided.

According to a further feature of the present invention, a connecting arm may be provided which is telescopically constructed so that a matching to the bridge sections of different lengths is readily realized in an extremely simple manner.

According to yet another feature of the present invention, the connecting arm may be hinged at the free end thereof facing away from the support of the rear placer at the vehicle and may engage a guide means for receiving and depositing of the bridge portions on the vehicle.

According to a further feature of the present invention, the connecting arm is detachably arranged at the rear placer whereby the connecting arm may be advantageously rapidly assembled and disassembled in a simple manner in accordance with the specific lengths of the respective bridge sections. Thus, the bridge transporting and installing vehicle can readily be loaded with long, short, or short and long bridge sections. Furthermore, in situations wherein the bridge sections are provided with supports or ramp sections, the weight and length of the supports or ramp sections may readily be accommodated by means of shortening one or both of the bridge sections.

Accordingly, it is an object of the present invention to provide a bridge trasporting and installing vehicle which avoids the shortcomings and drawbacks encountered in the prior art.

A further object of the present invention resides in a bridge transporting and installing vehicle which permits the transportation and installation of bridge sections of differing lengths.

Still another object of the present invention resides in providing a bridge transporting and installing vehicle which is provided with a bridge section placer having a connecting arm which may be readily assembled and disassembled to accommodate various length bridge sections.

These and other objects, features, and advantages of the present invention will become more obvious from the following description when taken in connection with the accompanying drawing which shows, for the purposes of illustration only, two embodiments of a bridge transport and installation vehicle is accordance with the present invention, and wherein.

Figure 1:
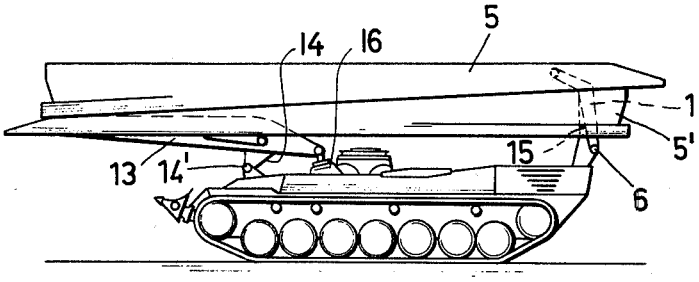
Fig.1 PRIOR ART
FIG. 1 is a side view of a conventional bridge placing and transport vehicle having two bridge sections of the same length disposed thereon.

Referring now to the drawings wherein like reference numerals are used throughout the various views to designate like parts and more particularly to FIG. 1, a multi-part bridge is disposed on a placement and transport vehicle generally designated by the reference numeral 7. The bridge consists of upper and lower bridge portions 5, 5′ of the same length. For transportation purposes, the upper and lower bridge portions 5, 5′ are stacked in a folded position one above the other and assume the position illustrated in FIG. 1.

A first or front bridge placer means 13 is provided and extends beneath the lower bridge portion 5′. The front placer 13 includes a support member 14 which is pivotally mounted about a pivot 14′ at the nose or front of the vehicle 7. Hydraulic working cylinders 16 connected to a suitable source of hydraulic fluid (not shown) are provided for selectively displacing the front placer 13. Additionally, rollers R are arranged at both sides of the front placer 13 on which the lower bridge portion 5' is guided during the placing and connecting process of the bridge structure.

As shown in FIG. 1, a rear placer 1 is arranged at the rear end of the vehicle 7 and is constructed as an angular level which is controlled by means of a hydraulic working cylinder 15 connected to a suitable source of hydraulic fluid (not shown). A suitable pivot means is provided for pivotally mounting the hydraulic working cylinder 15 on the vehicle 7.

As apparent from the construction of FIG. 1, the rear placer 1 is formed as an angular level and is only suitable for a bridge portion of equal length which, in the transport position, extend beyond the end of the rear placer arm 1 when such arm is in the upright position.

Figure 2:
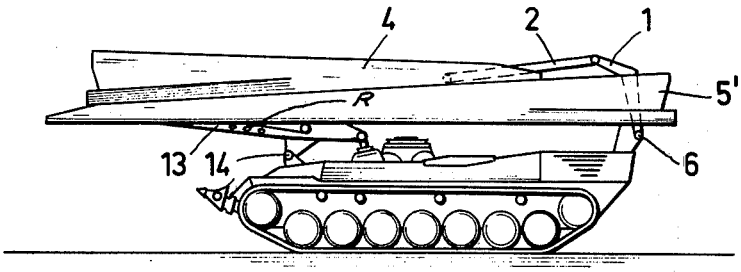
FIG. 2 is a side view of a bridge placement and transport vehicle in accordance with a first embodiment of the present invention having an upper shortened bridge portion and a lower longer bridge portion.
Figure 3:
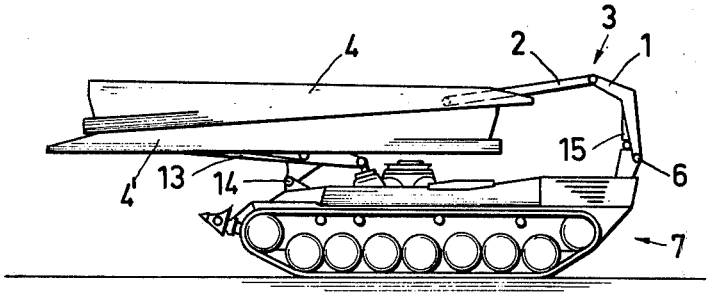
FIG. 3 is a side view of a further embodiment of a bridge placement and transport vehicle in accordance with the present invention including two short bridge portions disposed thereon.

As shown in FIGS. 2 and 3, according to the present invention, a bridge transporting and installing vehicle is provided which permits the combining and placing on the vehicle of either a short upper bridge section 4 and a longer lower bridge section 5 or two short bridge sections 4,4'. As apparent from both FIGS. 2 and 3, the upper bridge sections 4 in each instance terminate in front of the rear placer arm 1 and are not directly engageable therewith but are connected thereto by a connecting arm assembly 2 which extends toward the front of the vehicle in the longitudinal direction. The connecting arm assembly 2 bridges the difference in length which exists between the short bridge section 4, 4' and the long bridge section 5.

Figure 4:
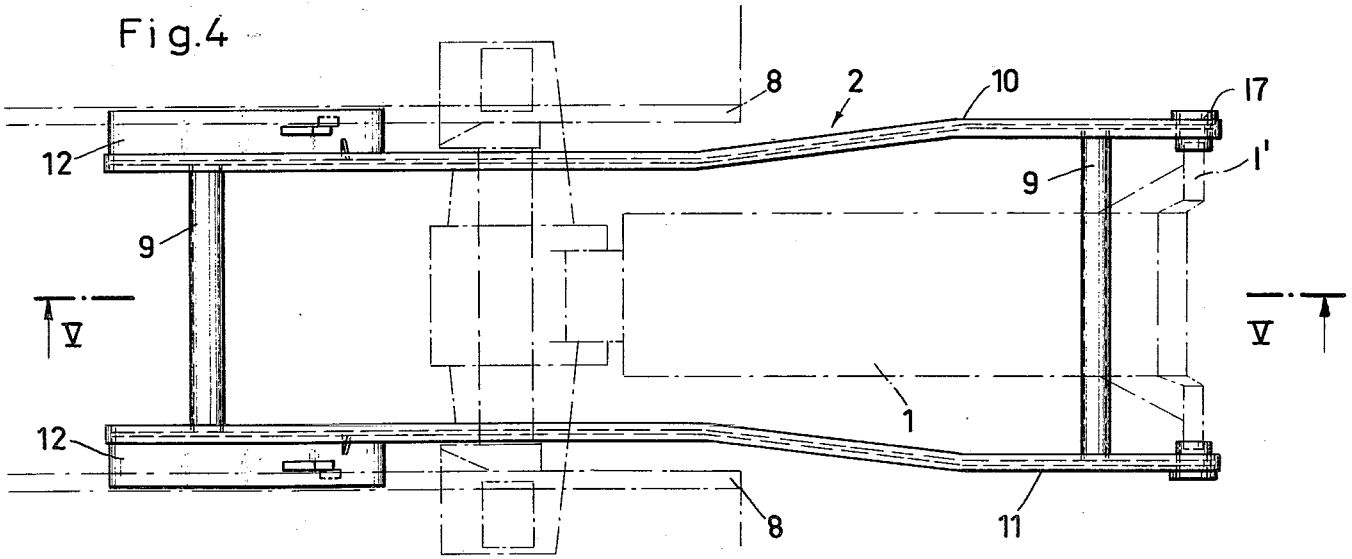
FIG. 4 is a top view of a connecting arm in accordance with the present invention.

As shown in FIG. 4, the connecting arm assembly preferably includes two parallely extending support members 10, 11 connected with each other by way of spaced transversely extending members 9. Guide cams 12 are arranged at the free ends of the support members 10, 11 on the outside thereof and are in engagement with guide tracks 8 provided at the bridge sections 4.

Figure 5:
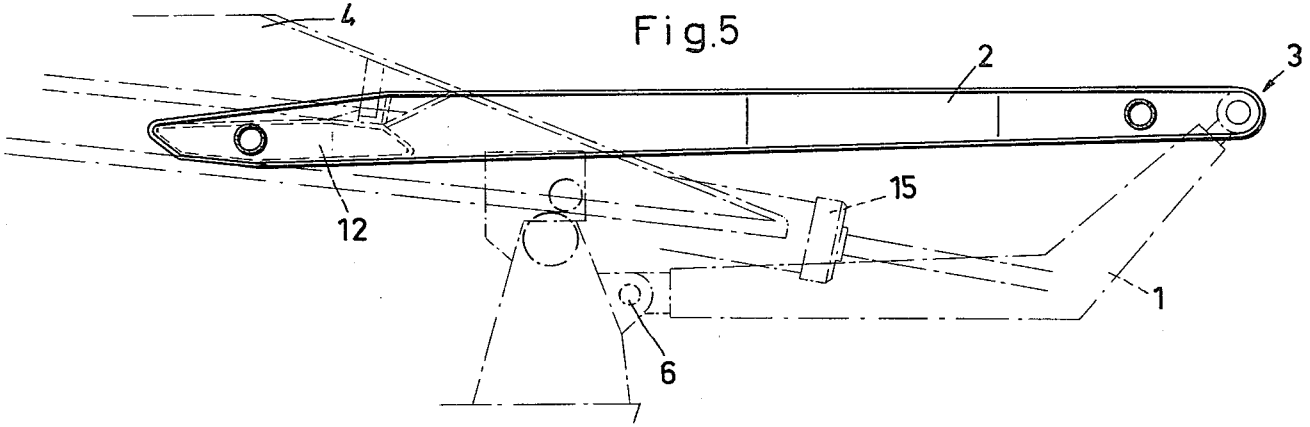
FIG. 5 is a view taken along line V — V of FIG. 4.

As shown in FIG. 5, one end of the rear placer arm 1 is pivotally mounted by means of a bearing 6 or the like to a support member provided on the vehicle 7. The other end of the rear placer arm 1 is pivotally connected to the connecting arm assembly 2 by a detachable connecting and locking means 3 whereby the axles or stubs 1' provided on the rear placer arm 1 can readily be attached or detached from the connecting arm assembly 2 to readily accommodate the various particular lengths of the bridge sections to be transported and installed.

To place or install the bridge sections, the rear placer 1 connected to the upper bridge section 4 is swung or displaced to the right with respect to FIGS. 2 and 3 by the hydraulic working cylinder 15 and is subsequently lowered into the plane of the lower bridge section 5' (FIG. 2) or 4' (FIG. 3).

Thereafter the lower bridge section 5' or 4' is displaced to the right by the hydraulic working cylinder 16 until the bridge sections 4, 5' or 4, 4' are in abutting or locked relationship whereby they may be interconnected. Subsequently, the connecting and locking means 3 in the rear placer 1 is released and the connected bridge is then rolled or slid in the longitudinal direction of the vehicle and emplaced. As readily apparent, to separate and remount the bridge sections on the vehicle 7 for subsequent transporting, the above placement steps are accomplished in the reverse order.

Figure 6:
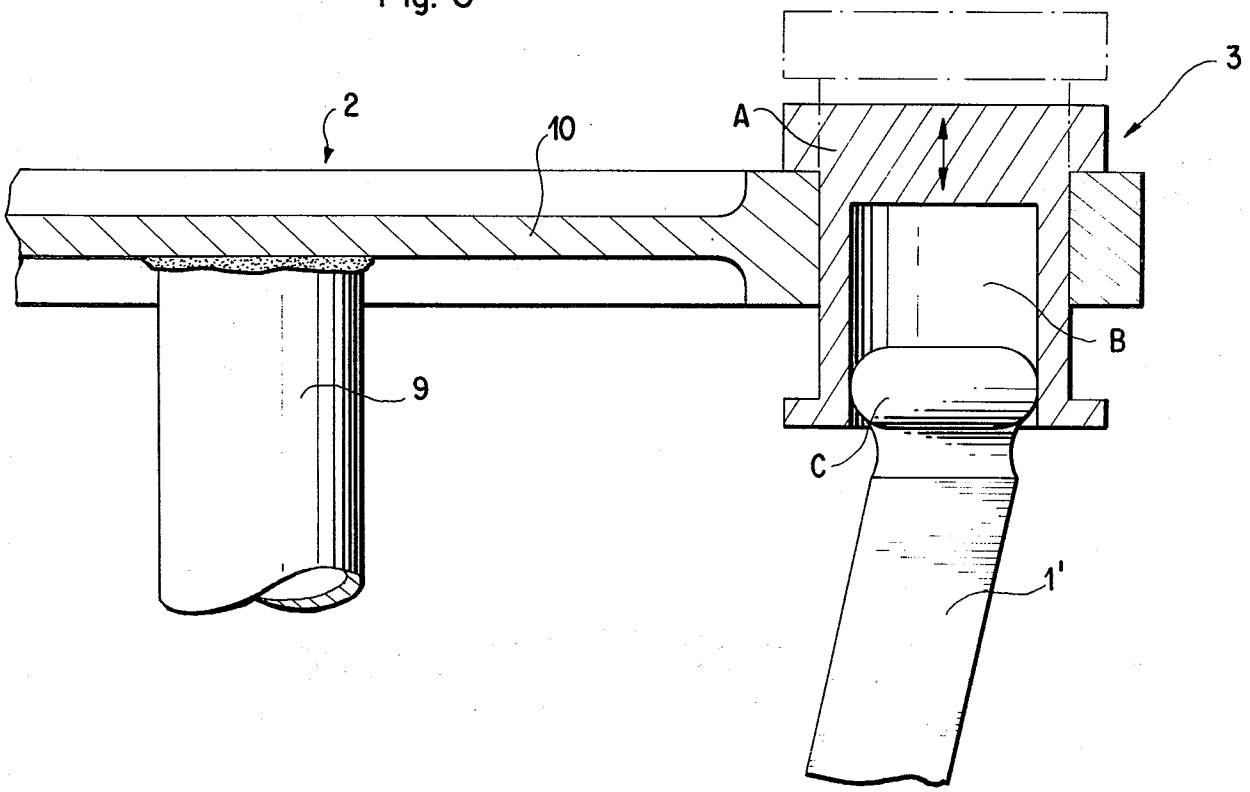
FIG. 6 is a cross-sectional view of a guide and locking means in accordance with the present invention.

As shown in FIG. 6, the guide connecting and locking means 3 includes a casing A which is received in a suitable bore provided in the connecting arm assembly 2. The casing A includes a recess or bore B which receives a roller or supporting pin C provided on the axles 1' of the rear placer 1. The casing A can be inserted in the connecting arm assembly or retracted therefrom such that in the inserted position, shown in solid line in FIG. 6, a force locking and form locking connection is produced between the connecting arm assembly 2 and the rear placer arm 1 by virture of the positive engagement between the roller or supporting pin C and the casing A. When the casing A is in the retraced or withdrawn position, shown in phanthom lines in FIG. 6, the roller or supporting pin C is released from the recess B and separation occurs between the connecting arm assembly 2 and the rear placer arm 1. The connecting arm assembly 2 remains connected to the rear placer arm 1 for placing short bridge sections 4, 4', however, when long bridge sections 5, 5' are to be placed, the connecting arm assembly 2 is separated from the rear placer arm 1 by disengaging the roller or supporting pin C from the casing A.

While the connecting rod assembly 2 is illustrated as including only a pair of supporting members 10, 11 one or more pairs of said supporting members may be provided and arranged so as to be telescopically adjustable thereby rendering the placement and transport vehicle 7 more readily adaptable to various lengths of bridge section.

While we have shown and described several embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A vehicle for transporting and installing a sectionalized bridge, the vehicle comprising:

at least two bridge sections disposed on the vehicle in an overlying relationship;

a first bridge section placer means mounted on the vehicle for selectively displacing a first of said at least two bridge sections in at least one direction;

means interposed between said first placer means and the first bridge section for operatively connecting said first placer means with the first bridge section;

a second bridge section placer means mounted on the vehicle for selectively displacing the second of the at least two bridge sections in at least one direction opposite to the direction of displacement of said first placer means, said second bridge placer means including at least one placer arm having a first end pivotally connected to the vehicle and a free end; and means provided on said second placer means for accommodating second bridge sections of varying lengths including a connecting arm assembly mounted between and operatively connecting said free end of said at least one placer arm and said second bridge section.

2. A vehicle according to claim 1, wherein the vehicle includes a front and rear portion, said first placer means being mounted on said front portion and said second placer means being mounted on said rear portion.

3. A vehicle according to claim 2, wherein said second placer means further includes means for guiding and locking the bridge section connected thereto.

4. A vehicle according to claim 3, wherein the first bridge section is disposed beneath the second bridge section on the vehicle, said first placer means being mounted on said vehicle beneath said first bridge section.

5. A vehicle according to claim 4, wherein means are interposed between said connecting arm assembly and said free end of said at least one placer arm for detachably connecting said connecting arm assembly to said placer arm.

6. A vehicle according to claim 4, wherein said second bridge section is provided with a guiding means for guiding the displacement thereof, and wherein said connecting arm assembly is provided with a means 12 engaging said guiding means.

7. A vehicle according to claim 6, wherein means are interposed between said connecting arm assembly and said free end of said at least one placer arm for pivotally connecting said connecting arm assembly to said placer arm.

8. A vehicle according to claim 7, wherein said connecting arm assembly includes at least a pair of spaced parallel support members extending in the longitudinal direction of the vehicle, one end of each of said support members being pivotally connected to said free end of said at least one placer arm and the other end of each of said support members being provided with said means for engaging said guiding means provided on said second bridge section.

9. A vehicle according to claim 8, wherein said means engaging said guiding means includes guide cams provided on said support members.

10. A vehicle according to claim 9, wherein said connecting arm assembly further includes a plurality of tranversely extending support elements connecting said spaced support members to each other.

11. A vehicle according to claim 10, wherein the varying lengths of the second bridge sections are less than the length of the first bridge section.

12. A vehicle according to claim 1, wherein means are interposed between said connecting arm assembly and said free end of said at least one placer arm for detachably connecting said connecting arm assembly to said placer arm.

13. A vehicle according to claim 1, wherein said second bridge section is provided with guiding means for guiding the displacement thereof, said connecting arm assembly being provided with means for engaging said guiding means.

14. A vehicle according to claim 13, wherein means are interposed between said connecting arm assembly and said free end of said at least one placer arm for pivotally connecting said connecting arm assembly to said placer arm.

15. A vehicle according to claim 14, wherein said connecting arm assembly includes at least a pair of spaced parallel support members extending in the longitudinal direction of the vehicle, one end of each of said support members being pivotally connected to said free end of said at least one placer arm and the other end of each of said support members being provided with said means engaging said guiding means provided on said second bridge section.

16. A vehicle according to claim 1, wherein the varying lengths of the second bridge sections are less than the length of the first bridge section.

17. A vehicle for transporting and installing a sectionalized bridge, the vehicle comprising:

at least two bridge sections disposed on the vehicle in an overlying relationship a first bridge section placer means mounted on the vehicle for selectively displacing a first of said at least two bridge sections in at least one direction;

means interposed between said first placer means and the first bridge section for operatively connecting said first placer means with the first bridge section;

a second bridge section placer means mounted on the vehicle for selectively displacing the second of the at least two bridge sections in at least one direction opposite to the direction of displacement of said first placer means; and means provided on said second placer means for accommodating second bridge sections of varying lengths including a connecting arm assembly mounted between said second placer means and said second bridge section, said connecting arm assembly including a first pair of spaced support members extending in the longitudinal direction of the vehicle, one end of each of said support members being pivotally connected to said second placer means, and at least a second pair of spaced support members extending in the longitudinal direction of the vehicle telescopically mounted on said first pair of support members.

18. A vehicle according to claim 17, wherein the second bridge section is provided with a means for guiding the displacement thereof, and wherein each of said second pair of support members is provided with a cam means engaging said guiding means.

19. A vehicle according to claim 17, wherein said second placer means includes at least one placer arm having a first end pivotally connected to the vehicle and a free end, said first pair of spaced support members being pivotally connected to said free end of said at least one placer arm.

20. A vehicle according to claim 19, wherein the varying lengths of the second bridge section are less than the length of the first bridge section.

21. A vehicle according to claim 20, wherein the second bridge section is provided with means for guiding the displacement thereof, each of said second pair of support members being provided with means engaging said guiding means.

* * * * *